United States Patent [19]

Errico

[11] 3,993,307

[45] Nov. 23, 1976

[54] TENNIS BALL CADDY

[76] Inventor: Giacomo J. Errico, 9 Cross St., Winchester, Mass. 01890

[22] Filed: June 30, 1975

[21] Appl. No.: 591,411

[52] U.S. Cl. ..... 273/73 R; 248/205 R; 248/226 E; 248/247

[51] Int. Cl.[2] ..... A63B 49/02

[58] Field of Search ..... 273/73 R, 74; 224/5 A, 224/5 D, 25 R, 29 B, 29 E, 29 R; 248/205 R, 38, 40, 41, 207, 236, 210, 214, 217, 220, 226 R, 226 E, 229, 247, 248

[56] References Cited

UNITED STATES PATENTS

| | | | |
|---|---|---|---|
| 1,622,586 | 3/1927 | Hoffman | 224/29 E X |
| 1,788,464 | 1/1931 | Kederis et al. | 224/29 B X |
| 2,088,980 | 8/1937 | Stein | 273/74 X |
| 2,388,142 | 10/1945 | Harris | 248/236 X |
| 2,429,342 | 10/1947 | Brown et al. | 273/74 X |
| 2,508,527 | 5/1950 | Martin et al. | 224/29 R X |
| 2,518,127 | 8/1950 | Dobbs | 224/29 E X |
| 2,593,222 | 4/1952 | Tracy | 248/236 X |
| 2,628,804 | 2/1953 | Goodman | 273/74 |
| 2,708,086 | 5/1955 | Prutzman | 248/205 R X |
| 2,801,105 | 7/1957 | Acton | 273/73 R |
| 2,930,156 | 3/1960 | Jones | 248/226 E X |
| 2,966,280 | 12/1960 | Nelson | 273/73 R X |
| 3,104,040 | 9/1963 | Stevens | 224/29 R |
| 3,278,148 | 10/1966 | Denaro | 248/210 |
| 3,730,466 | 5/1973 | Swanquist | 248/229 X |
| 3,895,772 | 7/1975 | Ellingson | 248/210 |

*Primary Examiner*—Richard J. Apley

[57] ABSTRACT

A device for holding a can of tennis balls onto a tennis racket press, comprising a pair of reinforced brackets, one for each end of the press and adapted to be removably fastened thereto, each bracket including a curved spring clamp extending outwardly from one face of the press, the clamps being axially aligned and each being adapted to receive thereinto one end of said can.

8 Claims, 6 Drawing Figures

TENNIS BALL CADDY

BACKGROUND OF THE INVENTION

Many ways have been devised for removably carrying tennis balls on the tennis racket or the press therefor. Several use clamps attached to the press. Some of these use the press screws to attach them to the press. However, ways are needed to improve the latter type, such as by making clamp type devices less expensive to produce and sell, more efficient and foolproof, lighter in weight, and more convenient to store when not in use or when being stocked by the store owner.

In addition, the prior art devices are in several instances not easily adaptable to different size presses, and the problem of so making them easily adaptable needs solving.

SUMMARY OF THE INVENTION

Accordingly, it is the general object of this invention to provide an improved device for holding a can of tennis balls on a tennis racket press in a quick, firm, but instantly removable manner, the device being light but strong, adjustable for different sizes of presses, and economically manufacturable and sold.

Specifically, one object of the invention is to provide improved clamping means for the above purpose, the means being in two parts cooperative with the can, the parts being at opposite ends of the press and removably attachable thereto.

Another object of the invention is to provide clamping means of the aforesaid kind which is reinforced to insure proper maintenance of its shape and its fit to the racket press.

A third object of the invention is to provide clamping means of the above kind which is adaptable to several sizes of said presses.

A fourth object of the invention is to provide clamping means of any of the aforesaid kinds comprising a pair of cooperative clamps attachable to the press, and nestable one within the other when not on the press.

A fifth object of the invention is to provide clamps of the aforesaid kinds which may be nested within one another when detached from the racket.

Other objects, features and advantages will be in part apparent and in part pointed out hereinafter.

The invention accordingly comprises the elements and combinations of elements, features of construction, and arrangements of parts which will be exemplified in the structures hereinafter described, and the scope of the application of which will be indicated in the appended claims.

In the accompanying drawings, in which one of the various possible embodiments of the invention is illustrated:

Similar reference characters indicate corresponding parts throughout the several views of the drawings.

Figure 1:
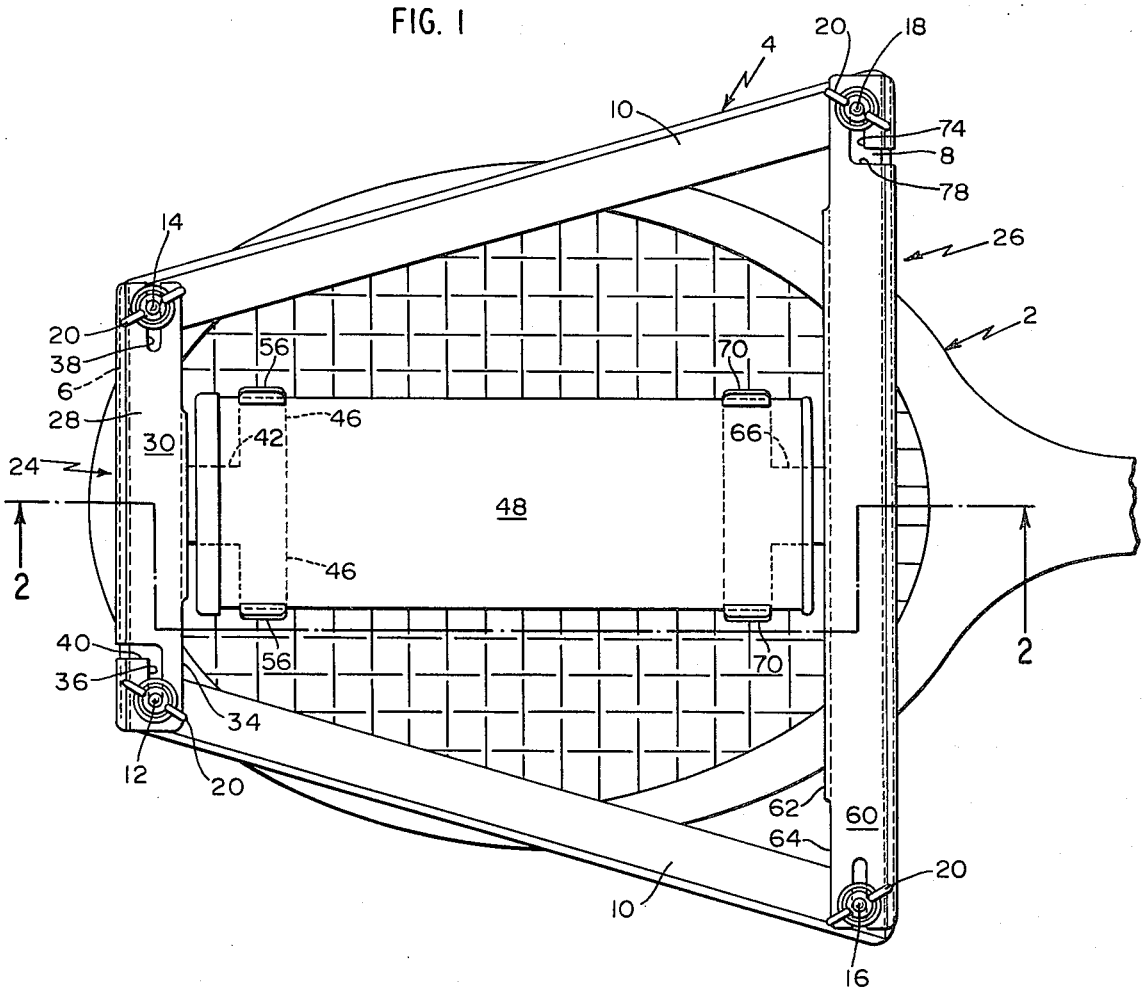
FIG. 1 is a plan view of a typical tennis racket held in a press therefore, the tennis ball clamping means of this invention being shown detachably mounted thereon.

Dimensions of certain of the parts as shown in the drawings may have been modified and/or exaggerated for the purposes of clarity of illustration and understanding the invention.

Figure 2:
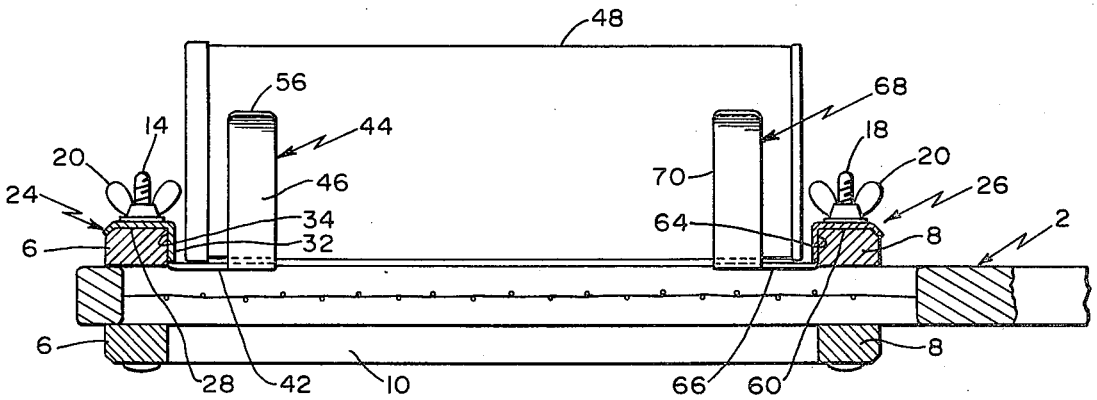
FIG. 2 is a sectional side elevation of the embodiment of FIG. 1 taken in the direction of sight line 2—2 on FIG. 1

Referring now to the drawings for a description of the invention, shown in FIGS. 1 and 2 are a tennis racket 2, clamped in a racket press 4. Press 4 has the usual construction and comprises the two flat frames one on each side of the racket, and each frame comprising the front and rear end pieces 6 and 8 respectively, and the side pieces 10. These pieces are permanently attached at their corners to make the respective frames. Four press screws 12, 14, 16 and 18 extend through the corners of the one frame (lower as drawn) and pass through the corners of the upper frame to extend thereabove. Wing nuts 20 are used to clamp the racket between the frames.

The above description of a racket press is given in order to establish the parts of the press by name for later use in the claims hereof.

The tennis ball can holder of this invention comprises two separately attachable clamp members indicated generally by numerals 24 and 26, each clamp member being basically the same except that the cross-bar of the clamp for the wider end of the press is longer than that for the shorter end. Each clamp member comprises the cross-bar, an extension therefrom, and a C-shaped spring means upstanding on the extension.

Figure 3:
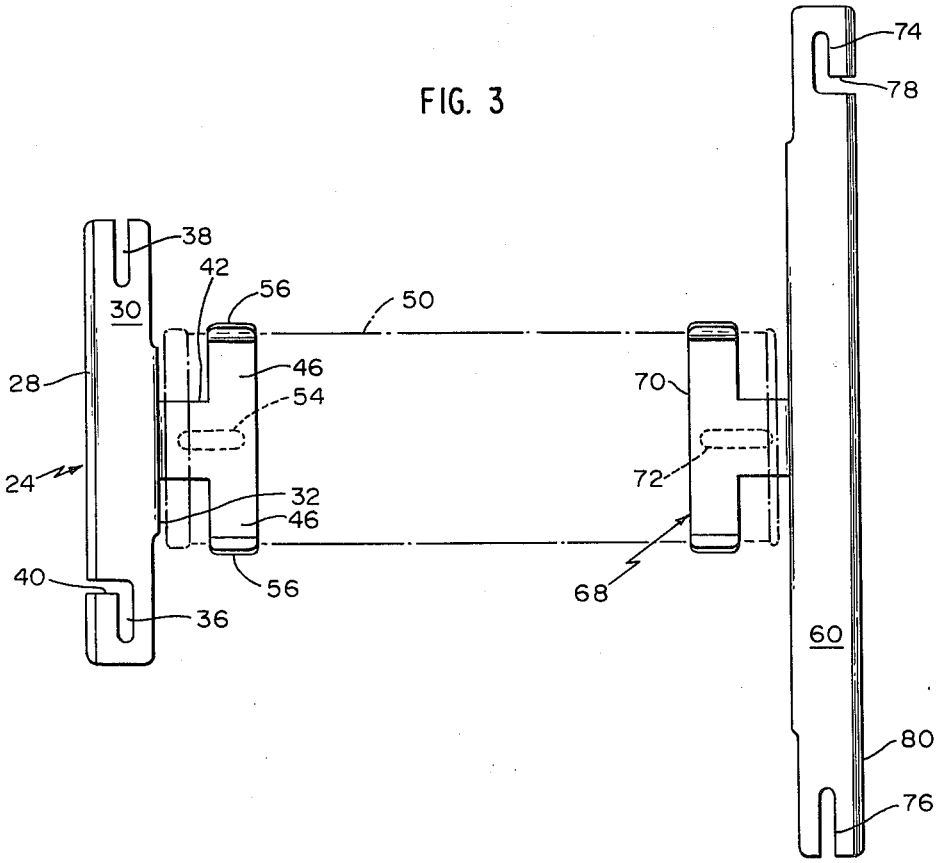
FIG. 3 is a plan view of the pair of clamping means of this invention detached from the racket press.

Referring particularly to clamp member 24, (and referring to FIGS. 1, 2 and 3) its cross-bar 28 is an angle piece having the upper top leg 30, and a side leg 32 attached thereto. Leg 32 is short enough in length to fit down against the inner face or edge 34 of end piece 6. The leg 30 lies along the upper surface of end piece 6 and extends the entire length of the latter. Leg 30 is provided with elongated slots 36 and 38 extending longitudinally of the leg 30. Slot 36 terminates in a transverse slot 40 which opens outwardly of the leg to receive screw 12. Slot 38 terminates openly at the end of the leg 30 and receives screw 14.

By means of the elongated slots, the clamp member 24 is adapted to fit a racket press, the distance between whose screws 12, 24 is such that the screws will be within the slots when the member 24 is fastened to the end of the press by means of wing nuts.

An extension 42 is attached to the leg 32 at approximately the center thereof. Preferably the extension is an integral part of the leg. Its width is sufficient to give it enough rigidity to hold securely the upstanding C-shaped spring means 44. The spring means has the two arcuate legs 46 which are so sized as to receive within their embrace one end of a can 48 of tennis balls, (see FIG. 1) and indicated by dotted lines 50 in FIG. 3

Figure 4:
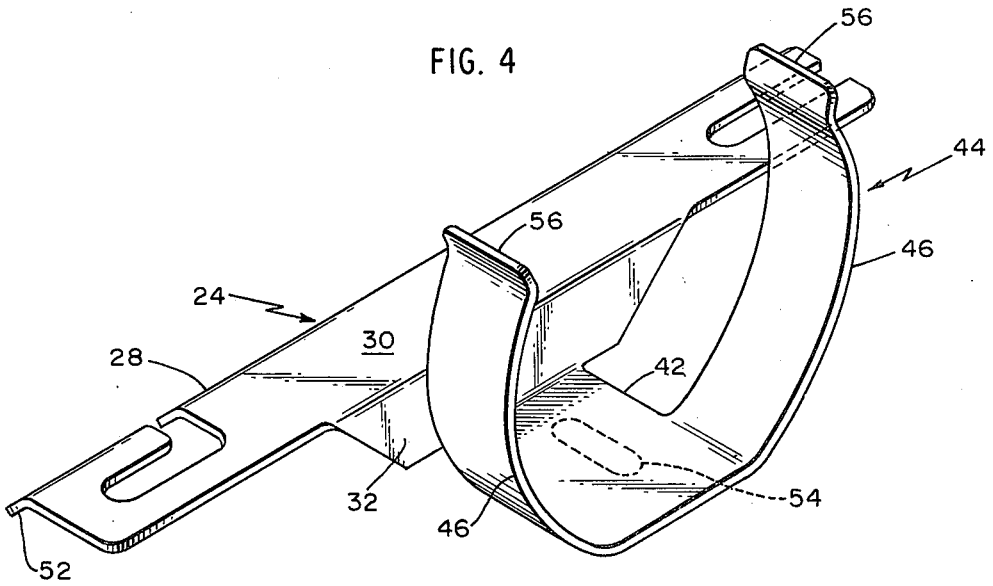
FIG. 4 is a view taken of one clamp of this invention, the drawing being enlarged as compared to FIGS. 1–3, to illustrate certain details of construction.

Mention has been made that the clamps of this invention are reinforced. This is done by bending the outer edge 52 of leg 30 at an angle (see FIG. 4) which imparts rigidity to the leg. In addition, the downwardly bent leg 32 stiffens the angle length. The extension 42 is of short length, and in the commercial example, this extension is approximately 1.4 cm. long, between the inner edge of the arms and the leg 32, and 2.5 cm. wide, with a thickness of about 1.6 mm. With these dimensions it will be found to be quite rigid. Of course, the right angle relation of leg 32 and extension 42 strengthens the latter against torsional twist. If desired, an elongated depression, indicated by dotted lines 54, may be "bumped" into the extension 42 to impart rigidity lengthwise.

The arcuate legs are bowed, as shown, to the proper radius of curvature so that when the end of the ball can is pressed downwardly against the outwardly bent lips 56, the arms will spread apart to admit the can, and then resiliently close on the can to hold it securely.

Referring now to the other clamp 26, its construction is the same as that of clamp 24, except that the cross-bar 26 is longer than bar 24, but like the latter extends the full length of the press cross piece 8. Bar 26 is an angle piece and has the flat top leg 60, similar to flat top leg 30. Side leg 62 is attached thereto, extends along the inside edge 64 of the press end piece 8. The legs of the angle cross-bar reinforce each other.

An extension 66 like extension 42 is attached to leg 62 as shown, and at the outer end bears the upstanding C-shaped spring means 68, like spring means 44 in all respects. This spring means has the arcuate legs 70 which are so bowed as to be adapted to receive therein the other end of the tennis ball can.

The extension 66 can, if desired, be reinforced by an elongated depression 72 "bumped in", as shown by dotted lines.

Again, as in the case of the spring member 44, the arms 70 have outwardly turned ends so that when the other end of the can is pressed against them, the can spreads the arms apart to receive the can. The arms then resiliently move back to hold the can.

Just as in regard to the top leg 30, leg 60 is provided with elongated slots 74, 76. Slot 74 terminates in a transverse slot 78 which opens into the edge 80 of the leg 60. The other slot 76 opens into the end of the flat leg 60. Both slots thus permit the leg 60 to be slid over the press screws 16 and 18, and the cross arm is clamped to the press by the wing nuts 20.

It will be noted that when the clamps are fastened to the press, the axes of the C-shaped clamping members are coaxial.

The dimensions of the clamp 26 are the same as those of clamp 24, except for the additional lengths of legs 60 and 62 due to the longer length of press end piece 64, and the fact that the C-shaped members 44 and 68 are so dimensioned that when the parts are detached from the press, they may be nested.

Figure 5:
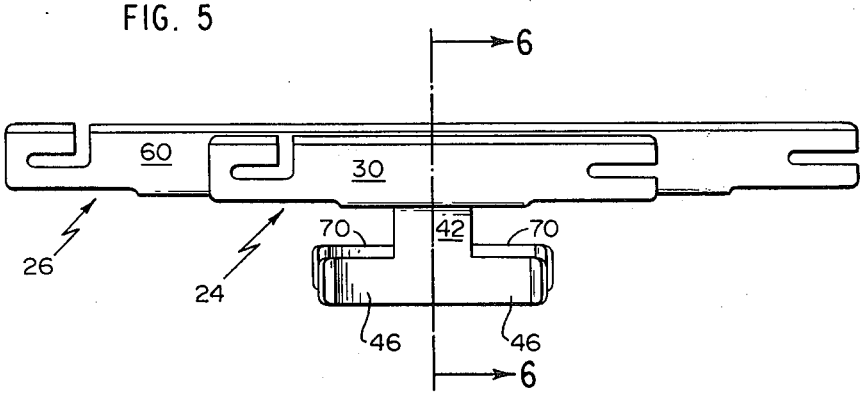
FIGS. 5 and 6 are respectively plan and section elevation views showing the clamps nested, FIG. 6 being taken in the direction of sight lines 6–5 on FIG. 6.
Figure 6:
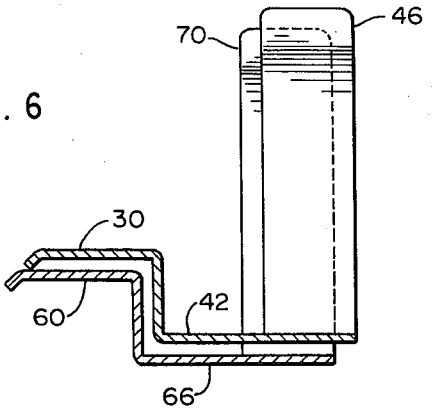

Referring to the latter, FIGS. 5 and 6 show such nesting. When the top leg 30 is slid over top leg 60, the spring 70 may be expanded slightly to embrace the arms 46.

In view of the above it will be seen that the several objects of the invention are achieved and other advantageous results attained.

It is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

As many changes could be made in the above constructions without departing from the scope of the invention, it is intended that all matter contained in the above description or shown in the accompanying drawings, shall be interpreted as illustrative and not in a limiting sense, and it is also intended that the appended claims shall cover all such equivalent variations as come within the true spirit and scope of the invention.

Having described the invention, what I claim is:

1. A device for holding a can of tennis balls onto a tennis racket press comprising in combination a pair of clamp members, one each being adapted to be removably attached to a respective end of the press; each clamp member comprising a rigid elongate cross-bar of sheet material adapted to lie against and parallel with the respective transverse end member of the press and to be secured to that end member at spaced apart locations, an extension member attached by one end thereof to the cross-bar and extending therefrom toward the other end of the press, and a generally C-shaped clamping means attached to the other end of each of the extension member in a direction extending from the plane of the press perpendicularly thereto, and with its axis parallel to the longitudinal length of the press; the axis of the spring clamping means of one clamp member being coaxial with that of the other spring clamping means; each spring clamping means being adapted to receive and removably retain therein one end of a can of tennis balls.

2. The device of claim 1 in which each of said cross-bars is an angle bar with the sides thereof at right angles, one of said sides being adapted when mounted on the racket press to lie on the top of the transverse end member of the press, and the other side of the angle bar extending downwardly and lying against the inner side of said transverse end member, said extension member being attached to said other side of the angle bar.

3. The device of claim 1 in which each of said cross-bars is provided at the ends thereof with elongated slots extending in a direction along the length of the cross-bar, each slot being provided with an opening at the outer end thereof to permit the entry of a racket press screw, the respective cross-bar being clampable to the press by the press nuts, and being adaptable to fit various sizes of presses by the adjustable positioning of the press screws in said slots.

4. The device of claim 2 in which said one side of each of said cross-bars is provided at the ends thereof with elongated slots extending in a direction along the length of the side, each slot being provided with an opening at the outer end thereof to permit the entry of a racket press screw, the respective cross-bar being clampable to the press by the press nuts, and being adaptable to fit various sizes of presses by the adjustable positioning of the press screws in said slots.

5. The device of claim 2 in which said C-shaped spring members, and the angle bars are integrally formed from one piece of metal.

6. The device of claim 2 in which each of the C-shaped spring members comprises two arcuate legs having their lower ends attached integrally to said extension, and their upper ends free and spaced apart, portions of each of said legs being curved away from each other to form an opening adapted to receive said can between the legs, and the legs being flat in cross-section.

7. The device of claim 2 in which the angle-bar, length of said extension, and shape and size of each clamp member is such that when the clamp members are not attached to the racket, the clamp members are adapted to nest the one in the other.

8. The device of claim 2 in which the parts thereof are made of high strength aluminum.

* * * * *